US011391260B2

(12) United States Patent
Hastall et al.

(10) Patent No.: US 11,391,260 B2
(45) Date of Patent: Jul. 19, 2022

(54) METHOD FOR OPERATING AN INTERNAL COMBUSTION ENGINE, AND CONTROLLER FOR CARRYING OUT THE METHOD

(71) Applicant: Robert Bosch GmbH, Stuttgart (DE)

(72) Inventors: Andreas Hastall, Stuttgart (DE); Robert Manfred Zielke, Schwieberdingen (DE); Ronald Ritter, Notzingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 17/284,577

(22) PCT Filed: Sep. 4, 2019

(86) PCT No.: PCT/EP2019/073556
§ 371 (c)(1),
(2) Date: Apr. 12, 2021

(87) PCT Pub. No.: WO2020/074185
PCT Pub. Date: Apr. 16, 2020

(65) Prior Publication Data

US 2021/0332783 A1 Oct. 28, 2021

(30) Foreign Application Priority Data

Oct. 10, 2018 (DE) ..... 10 2018 217 335.4

(51) Int. Cl.
*F02P 17/12* (2006.01)
*H01T 13/60* (2011.01)

(52) U.S. Cl.
CPC ..... *F02P 17/12* (2013.01); *H01T 13/60* (2013.01); *F02P 2017/121* (2013.01); *F02P 2017/125* (2013.01)

(58) Field of Classification Search
CPC ..... F02P 17/12; F02P 2017/121; F02P 2017/125; H01T 13/60
(Continued)

(56) References Cited

U.S. PATENT DOCUMENTS 3,871,349 A * 3/1975 Hager ..... F02P 13/00 313/134
6,487,899 B1 * 12/2002 Wahl ..... G01M 15/10 73/114.09
(Continued)

FOREIGN PATENT DOCUMENTS

DE 3048895 A1 7/1982
DE 19901795 A1 7/2000
(Continued)

OTHER PUBLICATIONS

Translation of International Search Report for Application No. PCT/EP2019/073556 dated Oct. 15, 2019 (3 pages).

*Primary Examiner* — Erick R Solis
(74) *Attorney, Agent, or Firm* — Michael Best & Friedrich LLP

(57) ABSTRACT

The invention relates to a method for operating an internal combustion engine with fuel which is combusted using a spark plug. According to the invention, the aging of the spark plug, in particular the aging of an electric resistor of the spark plug, is monitored during the operation of the internal combustion engine, wherein electromagnetic radiation of the spark plug is detected for monitoring purposes. The invention additionally relates to a controller for carrying out the method.

13 Claims, 3 Drawing Sheets

(58) Field of Classification Search
USPC ..... 701/29.4; 123/169 R, 406.13, 630; 73/114.62
See application file for complete search history.

(56) References Cited

U.S. PATENT DOCUMENTS

| | | | | |
|---|---|---|---|---|
| 2003/0006775 | A1 | 1/2003 | Wright | |
| 2003/0038635 | A1* | 2/2003 | McQueeney | F02P 13/00 324/388 |
| 2004/0084036 | A1* | 5/2004 | Porter | F02P 3/0453 123/634 |
| 2014/0352662 | A1* | 12/2014 | Serizawa | H05H 1/52 123/406.27 |
| 2014/0361789 | A1* | 12/2014 | Ohtsuka | G01R 31/1218 324/551 |

FOREIGN PATENT DOCUMENTS

| | | | |
|---|---|---|---|
| DE | 102013015063 | B3 | 3/2015 |
| DE | 102015214057 | A1 | 1/2017 |
| DE | 102016206993 | A1 | 10/2017 |
| EP | 0468572 | A1 | 1/1992 |
| WO | 2005027287 | A1 | 3/2005 |
| WO | 2008011591 | A2 | 1/2008 |

* cited by examiner

METHOD FOR OPERATING AN INTERNAL COMBUSTION ENGINE, AND CONTROLLER FOR CARRYING OUT THE METHOD

BACKGROUND OF THE INVENTION

The invention relates to a method for operating an internal combustion engine. In addition, the invention relates to a control unit for carrying out the method according to the invention.

Internal combustion engines powered by non-self-igniting fuels can be ignited with the help of a spark plug. Such a spark plug is exemplified by the disclosure document DE 10 2015 214 057 A1. It includes an insulator with a cavity extending along a longitudinal axis, in which a central electrode at one end and a connection electrode at the other end are accommodated in such a way that they each protrude past the insulator. An electrical resistance is formed between the central electrode and the connection electrode. Furthermore, the spark plug comprises a ground electrode, which is arranged at a distance from the central electrode.

If a high voltage is applied to the central electrode via the connection electrode and the electrical resistance, an ignition spark that jumps from the central electrode to the ground electrode is generated, the thermal energy of which ignites the fuel or the fuel-air mixture in the combustion chamber of the combustion engine.

Spark plugs of the above type, in particular their electrical resistances, are subject to an aging process. This means that their service life is limited. The aging of the electrical resistance of a spark plug usually has a characteristic profile. First, the electrical resistance decreases, which causes the electrode burn-off or electrode wear to increase. Due to the reduced electrical resistance, an increased electromagnetic radiation is also emitted to the environment, which has a disturbing effect and is therefore also referred to as interference radiation. Shortly before the end of the life of the spark plug, the electrical resistance usually rises sharply, which can lead to the failure of the ignition spark.

To prevent this, the spark plug is replaced before it reaches the end of its life. Since this time is not known, the exchange is made on suspicion, i.e. at regular intervals, which define the necessary maintenance intervals.

If the spark plug change is made too early, this proves to be uneconomical. In the case of large engines in particular, spark plug replacement can be a relevant cost factor. The present invention is therefore based on the object of specifying a method for operating an internal combustion engine, which helps to save time and costs by longer maintenance intervals.

SUMMARY OF THE INVENTION

In the proposed method for operating an internal combustion engine with a fuel ignited by means of a spark plug, the aging of the spark plug, in particular the aging of an electrical resistance of the spark plug, is monitored during the operation of the internal combustion engine, wherein an electromagnetic radiation of the spark plug is detected for monitoring.

As already mentioned at the beginning, the aging of the spark plug, in particular the aging of the electrical resistance of the spark plug, is linked with the increased electromagnetic radiation of the spark plug during ignition. By detecting the electromagnetic radiation, a corresponding increase can be detected and used as an indication of aging of the electrical resistance of the spark plug. Thus, the condition of the spark plug can be monitored during the operation of the internal combustion engine, without having to carry out elaborate measurements and/or to remove the spark plug. With the method according to the invention, the increased electromagnetic radiation of the spark plug with reduced electrical resistance is used to control the aging of the spark plug or the electrical resistance of the spark plug.

On the basis of the detected electromagnetic radiation of the spark plug, it can be determined whether replacement of the spark plug is necessary or pending. This means that the replacement takes place when it is indicated, and not due to elapsed time or, in the case of a vehicle, due to the kilometers driven. This makes the maintenance intervals longer, which has a time-saving and cost-saving effect. As a result, the internal combustion engine can be operated more economically.

Preferably, the current electrical resistance of the spark plug is determined on the basis of the detected electromagnetic radiation. This presupposes that the initial electromagnetic radiation of the spark plug is known or has been detected before, so that an increase in electromagnetic radiation as such is detected. The current electrical resistance can be concluded from the extent of the increase.

Furthermore, changes in the electromagnetic radiation of the spark plug are preferably detected and compared with a characteristic resistance profile of a known wear model. This allows a very precise determination of the current electrical resistance of the spark plug.

In a development of the invention it is proposed that the remaining life of the spark plug until its failure is estimated on the basis of the detected changes of electromagnetic radiation and the known wear model. This means that the failure of the spark plug is predicted. On the basis of the prediction, the latest date can then be determined at which the spark plug must be replaced. To increase reliability, the prediction can be made within a confidence band.

Advantageously, an adaptation of the operating strategy is made on the basis of the electromagnetic radiation detected. This applies in particular if a change in electromagnetic radiation has been detected from which aging of the spark plug or of the electrical resistance of the spark plug can be concluded. If the operating strategy is adjusted on the basis of this information, the aging process can be stopped or slowed down. For example, premature electrode wear due to increased electromagnetic radiation can be prevented by adjusting the operating strategy. For example, adjusting the operating strategy can include changing the dwell angle. Age-related disadvantages, such as increased electrode burn-off and/or increased electromagnetic coupling, can be compensated in this way. As a result, the maintenance intervals can be further extended.

For detecting the electromagnetic radiation of the spark plug, a radiation receiver, for example, an antenna, is preferably used. The radiation receiver may be installed within the engine compartment of the internal combustion engine, for example. If an antenna is used as a radiation receiver, it is preferably a directed antenna to avoid sources of interference.

When the electromagnetic radiation of the spark plug is detected, data are generated, in particular measurement data. These must be evaluated in order to obtain the desired information. According to a first preferred embodiment of the invention, the data generated during the detection of electromagnetic radiation are processed, in particular evaluated, in a control unit of the internal combustion engine. The control unit of the internal combustion engine usually has access to all relevant operating parameters of the internal combustion engine, so that if necessary these can be taken into account when evaluating the data. In addition, if necessary an adjustment of the operating strategy can be carried out with the help of the control unit. Suitable logic is preferably stored in the control unit.

Alternatively or in addition, it is proposed that when detecting the electromagnetic radiation generated data are processed, in particular evaluated, in an external control unit and/or in an external evaluation device. This has the advantage that the logic stored on the control unit of the internal combustion engine does not have to be changed, but the logic is simply outsourced, for example to retrofit an already existing internal combustion engine ("retrofit" solution). Preferably, the data are transmitted wirelessly, for example using a telematics and/or cloud service, to the external control unit and/or to the external evaluation device. Telematics and/or cloud service providers may, for example, be the manufacturer of the internal combustion engine and/or a data hoster having the necessary infrastructure for these services. The data transmission can be continuous or discontinuous.

Furthermore, it is proposed that classification algorithms are used to distinguish the electromagnetic radiation of the spark plug from other radiation in the environment and/or to calculate the current electrical resistance. In this way, the reliability of the indications or the accuracy of the calculations can be increased. The classification algorithms are preferably stored in the control unit and/or in the evaluation device which is used in the processing/evaluation of the data.

It is also proposed that detected altered electromagnetic radiation, which indicates aging of the spark plug or the electrical resistance of the spark plug, is assigned to a pre-defined damage class. Using regression of the determined damage class, a reliable prediction model can then be created to predict the failure of the spark plug.

A control unit that is set up to perform steps of a method according to one of the preceding claims. For example, the control unit can be an engine control unit. For carrying out the method, preferably logic or a computer program with a program code that performs the method when the computer program is running on the control unit is stored on the control unit. In this way, the method can be fully or at least partially automated.

BRIEF DESCRIPTION OF THE DRAWINGS

The invention is explained in more detail below on the basis of the attached drawings. In the figures.

DETAILED DESCRIPTION

Figure 1:
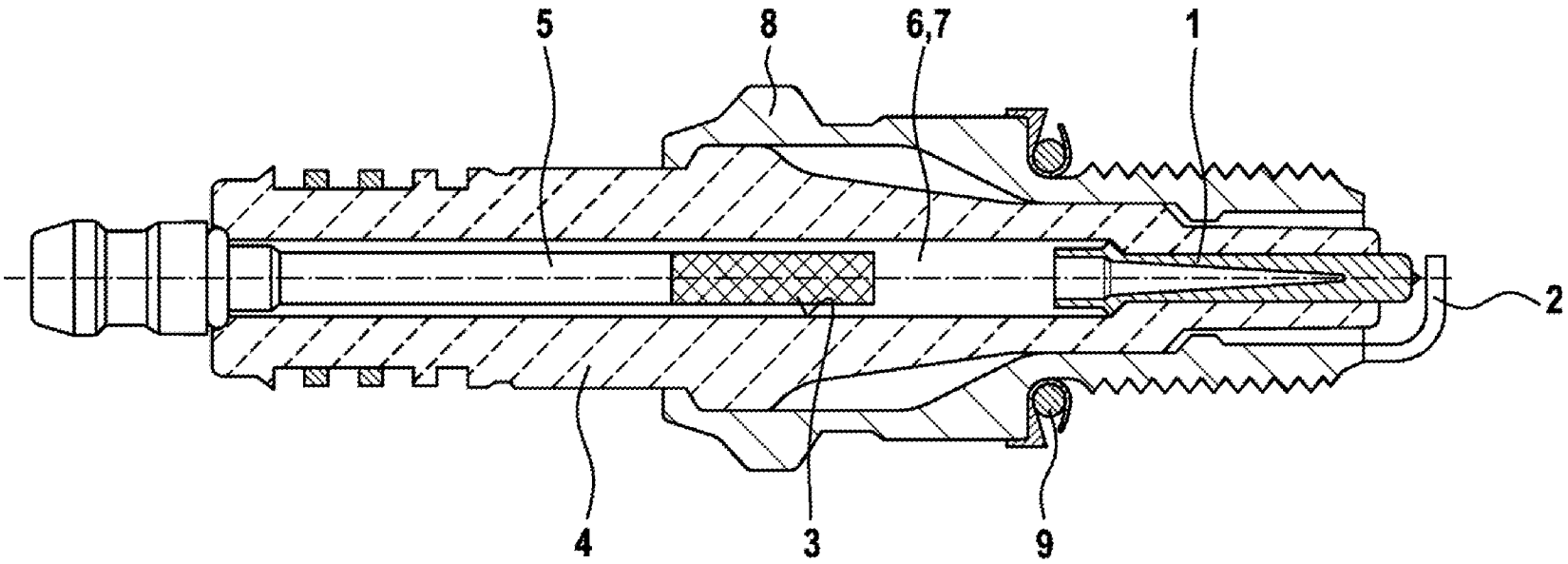
FIG. 1 shows a spark plug known from the prior art.

The spark plug shown in FIG. 1 is used in externally ignited internal combustion engines to ignite a fuel air mixture with a spark between two electrodes 1, 2. For this purpose, a high-voltage pulse is directed to a first electrode 1 by a system insulated from the motor, from which a spark then jumps across to the further electrode 2. The thermal energy of the jumping spark then ignites the fuel-air mixture.

The first electrode 1 is accommodated in a central cavity 3 of a sleeve-shaped insulator 4 and is therefore also referred to as a central or middle electrode. It consists of a nickel alloy and has a copper core. The further electrode 2 is a ground electrode 2 which is spaced apart from the first electrode 1. It also consists of a nickel alloy. The spark plug technology and the service life can be influenced by their arrangement and/or geometry.

In the central cavity 3 of the sleeve-shaped insulator 4, a connection bolt 5 is accommodated at the other end, which is preferably made of steel and is thus electrically conductive. The required high-voltage pulse is fed to the middle electrode 1 via the connection bolt 5. To limit the ignition current, an electrical resistance 6, which is realized in the present case by a glass melt 7, is arranged between the connection bolt 5 and the middle electrode 1. The electrical resistance 6 reduces the burn-off and thus the wear of the middle electrode 1. In addition, the electrical resistance 6 reduces the electromagnetic radiation emitted to the environment.

In the present case the sleeve-shaped insulator 4 is surrounded by a likewise sleeve-shaped housing 8, which is made of steel in the present case and is nickel-plated for protection against corrosion. The housing 8 can be used, for example, for fixing the spark plug in a cylinder head of an internal combustion engine of an engine. A sealing ring 9 arranged on the outside of the housing 8 is used to seal a combustion chamber of the internal combustion engine. To insulate the connection bolt 5 and the middle electrode 1 from the housing 8, the insulator 4 consists predominantly of alumina.

The spark plug, in particular the electrical resistance of the spark plug, is subject to aging processes. A characteristic resistance curve over the lifetime of the spark plug is shown in FIG. 2.

Figure 2:
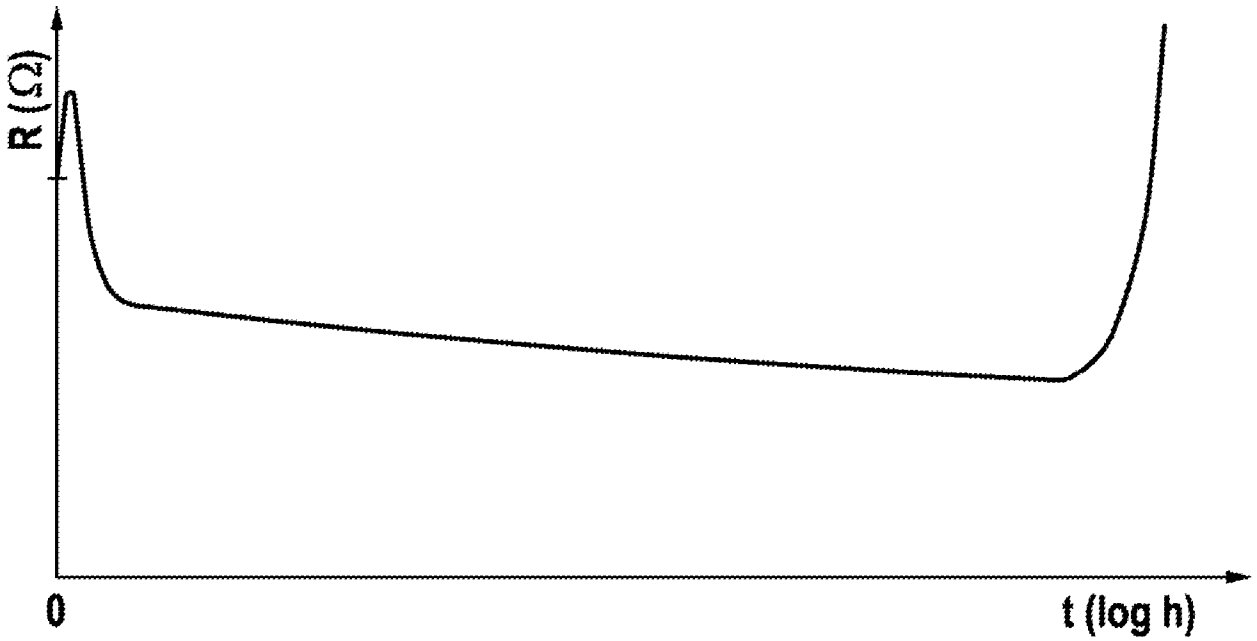
FIG. 2 shows a graphical representation of a characteristic resistance profile of a spark plug over its lifetime.

As can be seen from the profile of FIG. 2, the electrical resistance can initially increase in the short term, for example due to a formation of the glass melt or ceramic that serves as the electrical resistance. After that, the electrical resistance decreases, first quickly and then slowly but continuously. As a result, electrode burn-off and electromagnetic radiation increase. Shortly before the end of the spark plug life, the electrical resistance rises again, so that failure of the spark plug can occur.

In order to prevent this, according to the method according to the invention, the aging of the spark plug or the aging of the electrical resistance of the spark plug in the combustion engine is monitored, so that the spark plug can be replaced in good time. The replacement is therefore state-based and not time-related. This allows maintenance intervals to be extended and time and costs to be saved.

In order to monitor the aging of the spark plug or the aging of the electrical resistance of the spark plug, the electromagnetic radiation of the spark plug is detected during the operation of the internal combustion engine. Electromagnetic radiation increases when the electrical resistance decreases, so that due to this physical relationship the electrical resistance can be determined on the basis of the detected electromagnetic radiation.

If aging of the electrical resistance has been detected, the operating strategy can be adjusted during operation of the internal combustion engine to compensate for the disadvantages resulting from the aging, such as an increased electrode burn-off and/or increased electromagnetic coupling. In this way, progressive aging can be counteracted, which in turn favors longer maintenance intervals.

Figure 3:
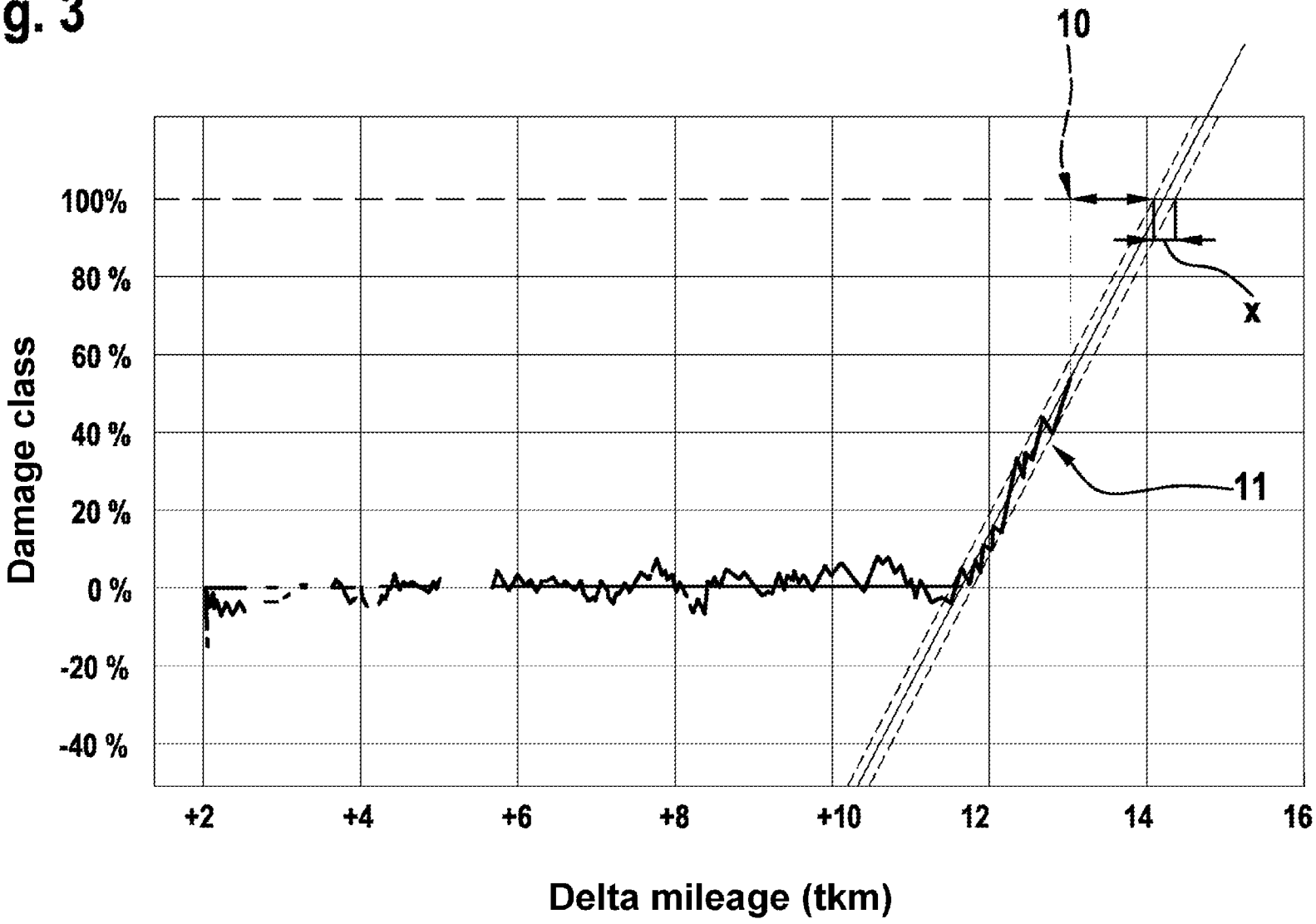
FIG. 3 shows a graphical representation of a prediction model.

As can be seen from FIG. 3 by way of example, a prediction model can be created with the help of the detected electromagnetic radiation. For the preparation of the prediction model of FIG. 3, the changes in electromagnetic radiation detected by means of a radiation receiver were assigned or classified in advance. Based on the historical profile of the assigned damage classes, a certain development, in this case the failure of the spark plug, can be predicted, which occurs when a predetermined threshold value 10 is reached.

The prediction can be made within a confidence band 11, the width of which is specified in FIG. 3 with the dimension x. Furthermore, it can be calculated after how many kilometers and/or how many further operating hours the ignition plug is likely to fail, so that the spark plug can be replaced beforehand.

At known operating points of the internal combustion engine, such as the engine speed, the dwell angle and/or the ignition time, the relevant electromagnetic radiation can be distinguished from other radiation in the environment by means of appropriate classification algorithms, for example by means of data mining.

Furthermore, the state of the spark plug resistance can be calculated with the help of these classification algorithms.

The proposed method can be used not only for internal combustion engines of motor vehicles, but also in the case of stationary internal combustion engines, which are used to generate energy, for example. Due to the size of such engines, the advantages of the invention are particularly evident here.

Irrespective of whether they are stationary or mobile internal combustion engines, existing internal combustion engines can be upgraded during retrofitting of engines which are suitable for carrying out the method according to the invention. For this purpose, only a suitable radiation receiver, such as a directed antenna, has to be arranged in the engine compartment and connected to a control unit and/or an evaluation device in a data-transmitting manner. This does not necessarily have to be an engine control unit but can also be realized by means of suitable external hardware.

The invention claimed is:

1. A method for operating an internal combustion engine with a fuel ignited by means of a spark plug, the method comprising:

monitoring aging of the spark plug during the operation of the internal combustion engine, and detecting electromagnetic radiation of the spark plug.

2. The method as claimed in claim 1, wherein a current electrical resistance of the spark plug is determined on the basis of the detected electromagnetic radiation.

3. The method as claimed in claim 1, wherein changes in the electromagnetic radiation of the spark plug are detected and compared with a characteristic resistance profile of a known wear model.

4. The method as claimed in claim 3, wherein the remaining life of the spark plug until its failure is estimated on the basis of the recorded changes in the electromagnetic radiation and the known wear model.

5. The method as claimed in claim 1, wherein an operating strategy of the internal combustion engine is adjusted on the basis of the detected electromagnetic radiation.

6. The method as claimed in claim 1, wherein an antenna is used for the detection of the electromagnetic radiation of the spark plug.

7. The method as claimed in claim 1, wherein data generated during the detection of electromagnetic radiation are processed in a control unit of the internal combustion engine.

8. The method as claimed in claim 1, wherein data generated during the detection of electromagnetic radiation are processed in an external control unit, wherein the data are transmitted to the external control unit wirelessly via a telematics and/or cloud service.

9. The method as claimed in claim 1, wherein classification algorithms stored in the control unit are used to distinguish the electromagnetic radiation of the spark plug from other radiation in the environment, for the calculation of the current electrical resistance, or both.

10. The method as claimed in claim 1, wherein a detected altered electromagnetic radiation is assigned to a previously defined damage class.

11. An electronic control unit configured to claim 1 monitor aging of a spark plug during operation of an internal combustion engine, detect, via an antenna, electromagnetic radiation of the spark plug, determine a current electrical resistance of the spark plug based on the detected electromagnetic radiation, and compare changes in the detected electromagnetic radiation with a characteristic resistance profile of a wear model.

12. An electronic control unit as claimed in claim 11, further configured to estimate a remaining life of the spark plug based on changes in the electromagnetic radiation and the wear model.

13. An electronic control unit further comprising at least one classification algorithm and wherein the electron control unit is configured to distinguish the electromagnetic radiation of the spark plug from other radiation in the environment using the at least one classification algorithm.

* * * * *